US005478064A

United States Patent [19]

Kalisiak

[11] Patent Number: 5,478,064

[45] Date of Patent: Dec. 26, 1995

[54] DELIVERING AND STACKING SHORT GRAIN FORMS

[75] Inventor: Michael S. Kalisiak, North Tonawanda, N.Y.

[73] Assignee: Moore Business Forms, Inc., Grand Island, N.Y.

[21] Appl. No.: 206,400

[22] Filed: Mar. 7, 1994

[51] Int. Cl.[6] ..... B65H 5/00

[52] U.S. Cl. ..... 271/264; 271/198; 198/721; 198/735.3

[58] Field of Search ..... 271/264, 272–275, 271/188, 198; 198/721, 725, 735.3

[56] References Cited

U.S. PATENT DOCUMENTS

| | | | |
|---|---|---|---|
| 3,980,295 | 9/1976 | Kleid | 271/272 X |
| 4,313,669 | 2/1982 | Larson et al. . | |
| 4,550,904 | 11/1985 | Union | 271/198 |
| 4,640,505 | 2/1987 | Placke et al. . | |
| 4,744,555 | 5/1988 | Naramore et al. . | |
| 4,964,627 | 10/1990 | Watts et al. . | |
| 5,152,522 | 10/1992 | Yamashita | 271/264 |

FOREIGN PATENT DOCUMENTS

| | | | |
|---|---|---|---|
| 59-203053 | 11/1984 | Japan | 271/188 |
| 218238 | 1/1990 | Japan | 271/264 |

*Primary Examiner*—David H. Bollinger
*Attorney, Agent, or Firm*—Nixon & Vanderhye

[57] ABSTRACT

Apparatus is provided for preventing a sheet drooping during sheet feeding in a first direction in a generally horizontal plane where a sheet is not entirely supported by a conveyor. A rod is mounted below the plane, having at least one collar with a support pin extending radially outwardly from the collar making an engagement angle of about 55–85 with respect to a second plane parallel to the horizontal plane and passing through the rod. The position of the support pin with respect to the rod may be readily adjusted, both the angle with respect to the second plane, and along the rod. Adjustment of the position of the collar with respect to the rod, in both modes, may be provided by a screw threaded fastener extending in a screw threaded bore intersecting the rod, and about 90° circumferentially spaced from the support pin. The support pin may have a truncated cone end with a rounded tip at the end for engaging a sheet. Also the position of the rod with respect to a feeding conveyor may be adjusted, as by using notched side plates that the rod fits in and is stabilized in so that it does not rotate with respect to the side plate.

16 Claims, 4 Drawing Sheets

FIG. 3
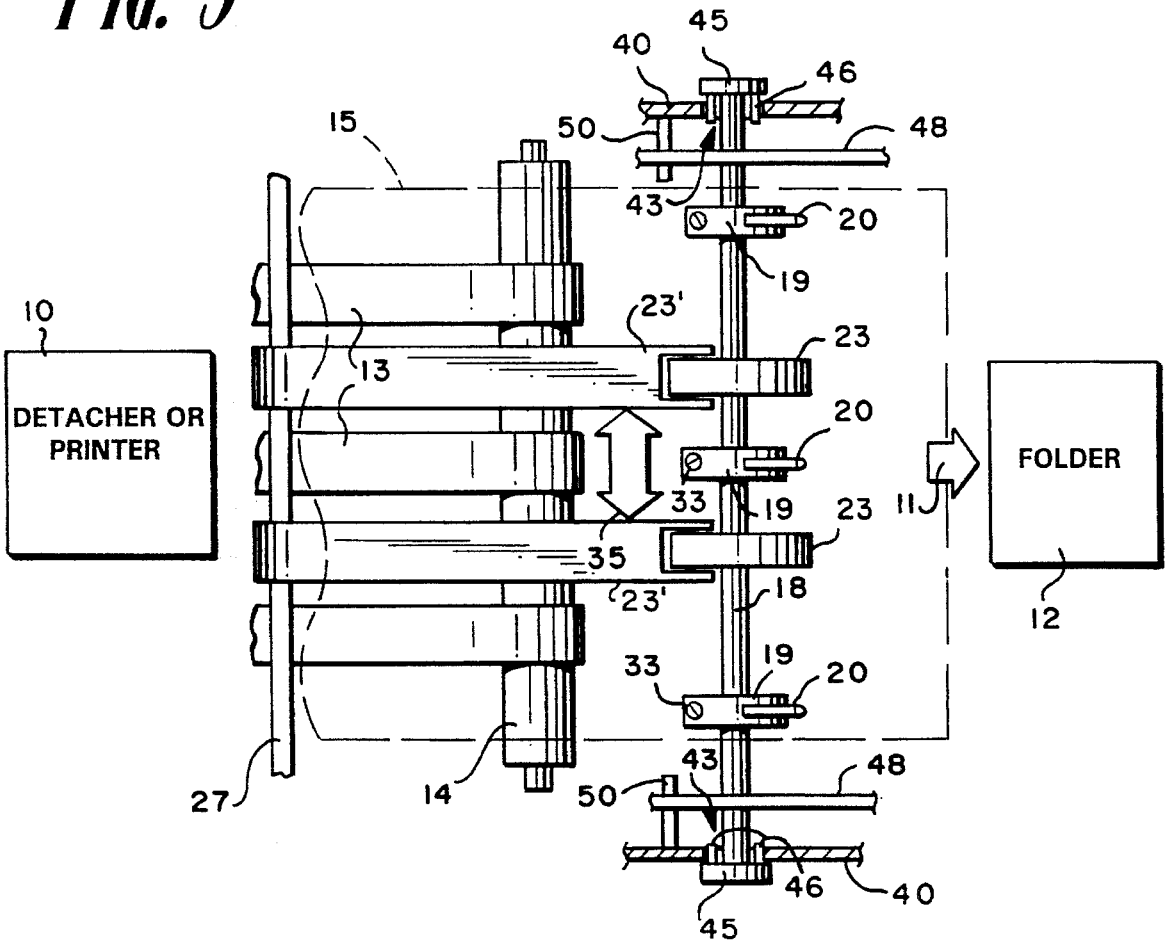
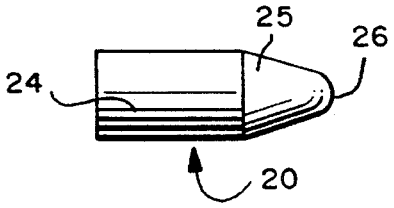
FIG. 4

FIG. 5
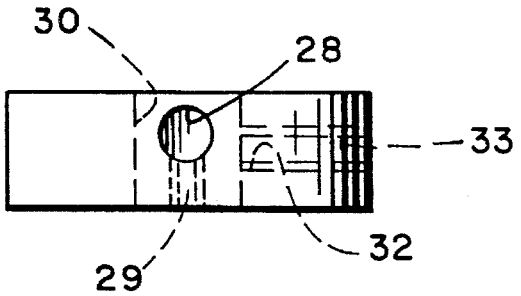
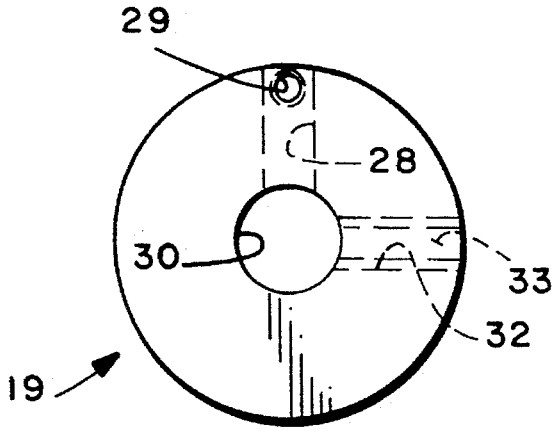
FIG. 6
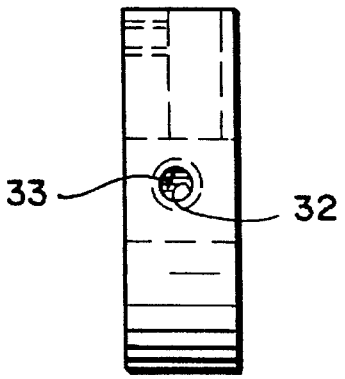
FIG. 7

DELIVERING AND STACKING SHORT GRAIN FORMS

BACKGROUND AND SUMMARY OF THE INVENTION

In many different types of business forms handling equipment, there are situations where during handling of the forms the forms are not positively supported along their entire extent in the direction of feed. For long grain forms (that is forms in which the orientation of the grain is in the direction of motion and thus the tendency for rigidity of the form in the direction of motion is high), that is not a significant problem. However for short grain forms, in which the grain is perpendicular to the direction of motion, such forms have a tendency to sag or droop, particularly if the business forms are single sheets, when the forms are not fully supported in the direction of motion. In order to accommodate that droop, a large number of prior art pieces of equipment have been proposed. While such equipment is satisfactory in achieving support, and/or creasing of the forms or sheets, this equipment has typically been unsatisfactorily complex.

According to the present invention, an apparatus for preventing sheet drooping during sheet feeding in a first direction, even short grain paper forms, is provided which is the ultimate in simplicity. While the apparatus according to the present invention is very simple, it is effective, and very versatile, being adjustable in many different ways to provide the optimum positioning of the sheet supporting elements depending upon the speed of feed, length of the forms, and rigidity of the forms, which adjustment can be quickly and easily accomplished.

According to one aspect of the present invention, apparatus for preventing sheet drooping during sheet feeding in a first direction in a generally horizontal plane where a sheet is not entirely supported by a conveyor comprises the following elements: Means for feeding forms in the first direction in a generally horizontal plane. And, means mounted below the plane for engaging, and supporting the bottom of a sheet moving in the first direction when the sheet droops. The means mounted below the plane comprising: a stationary rod; at least one collar mounted to the rod; and a support pin extending radially outwardly from the collar substantially perpendicular to the rod, the support pin making an engagement angle of between about 55 and 90 degrees with respect to a second plane parallel to the generally horizontal plane and passing through the rod. The engagement angle optimally is about 60°–85°, preferably 60°.

The apparatus also comprises first adjustment means for mounting the support pin to the collar and the rod to allow adjustment of the engagement angle, and second adjustment means for mounting the collar to the rod to allow adjustment of the position of the collar and support pin along the rod (axially). The first and second adjustment means may comprise the same mechanism, namely a threaded bore in the collar extending radially from the rod, and a threaded clamping screw extending into the bore and frictionally engaging the rod to hold the collar in both the circumferential and axial position on the rod to which it has been adjusted. The threaded clamping screw may extend 90° with respect to the support pin, and the support pin may comprise a truncated cone end, with a rounded tip at the end for engaging a sheet.

The apparatus further comprises third adjustment means for adjusting the position of the rod with respect to the feeding means. The third adjustment means comprises first and second notched side plates extending parallel to the first direction on opposite sides of the rod, and engagement means for engaging the side plates and holding the rod in position in a pair of aligned notches in the side plates. The engagement means may comprise a pair of outer collars mounted to the rod, opposite a side plate from the support pin; and at least one roll pin mounted on each the outer collars for engaging a side plate and precluding rotation of the rod in the notch. The engagement means preferably further comprises at least one elastic band extending over the rod for biasing the rod into the notches, but allowing movement of the rod out of the notches against the biasing.

The feeding means may comprise a plurality of conveyor tapes spaced from each other in a direction perpendicular to the first direction, the tapes terminating in an end roller spaced from the rod in the first direction.

Weighted nip wheels on movable arms also can be provided, above a horizontal plane centering the forms, to exert a downward pressure.

According to another aspect of the present invention a support pin assembly is provided comprising the following elements: A disc shaped collar generally disposed in a plane and having a central through extending bore extending perpendicular to the plane. A first radial bore in the collar. A second, threaded, radial bore in the collar intersecting the central bore. A support pin disposed in the first bore and extending radially outwardly therefrom past the periphery of the collar. And, a screw threaded fastener disposed in the second bore and being movable in the second bore by screw threaded engagement with the second bore to intersect the central bore.

The first and second bores are typically at substantially 90° with respect to each other, and the support pin typically has a truncated cone end with a rounded tip. The assembly also preferably comprises a rod extending through the central bore, the collar releasably held to the rod in a circumferential and longitudinal position to which it has been moved by frictional engagement between the screw threaded fastener and the rod. There also may be provided means for mounting the rod in different positions in a first dimension perpendicular to the rod, the mounting means comprising: First and second side plates each plate having a plurality of notches formed therein spaced from each other along the first dimension, pairs of notches in the side plates being aligned with each other; and engagement means for holding a rod in a pair of notches without allowing rotation of the rod in the notches, the engagement means including a pair of outer collars mounted on the rod remote from the support pin containing collar, each collar having at least one roll pin extending parallel to the rod and engaging the side plate, and at least one elastic band acting between the rod and at least one of the side plates for biasing the rod into the notches.

It is the primary object of the present invention to provide for the simple yet effective prevention of sheet drooping during sheet feeding, where the sheet is not entirely supported by a conveyor, especially in the feeding of short grain business forms. This and other objects of the invention will become clear from an inspection of the detailed description of the invention, and from the appended claims.

BRIEF DESCRIPTION OF THE DRAWINGS

FIG. 3 is a detail top plan view of a portion of the apparatus of FIG. 1;

FIG. 4 is a side view of the support pin used in the apparatus of FIGS. 1 through 3;

FIG. 5 is an end view, at the support pin opening, of the pin holding collar of the apparatus of FIGS. 1 through 3;

FIG. 6 is a side view of the collar of FIG. 5; and

FIG. 7 is an end view of the collar of FIGS. 5 and 6 at the screw threaded bore therein.

DETAILED DESCRIPTION OF THE DRAWINGS

Figure 1:
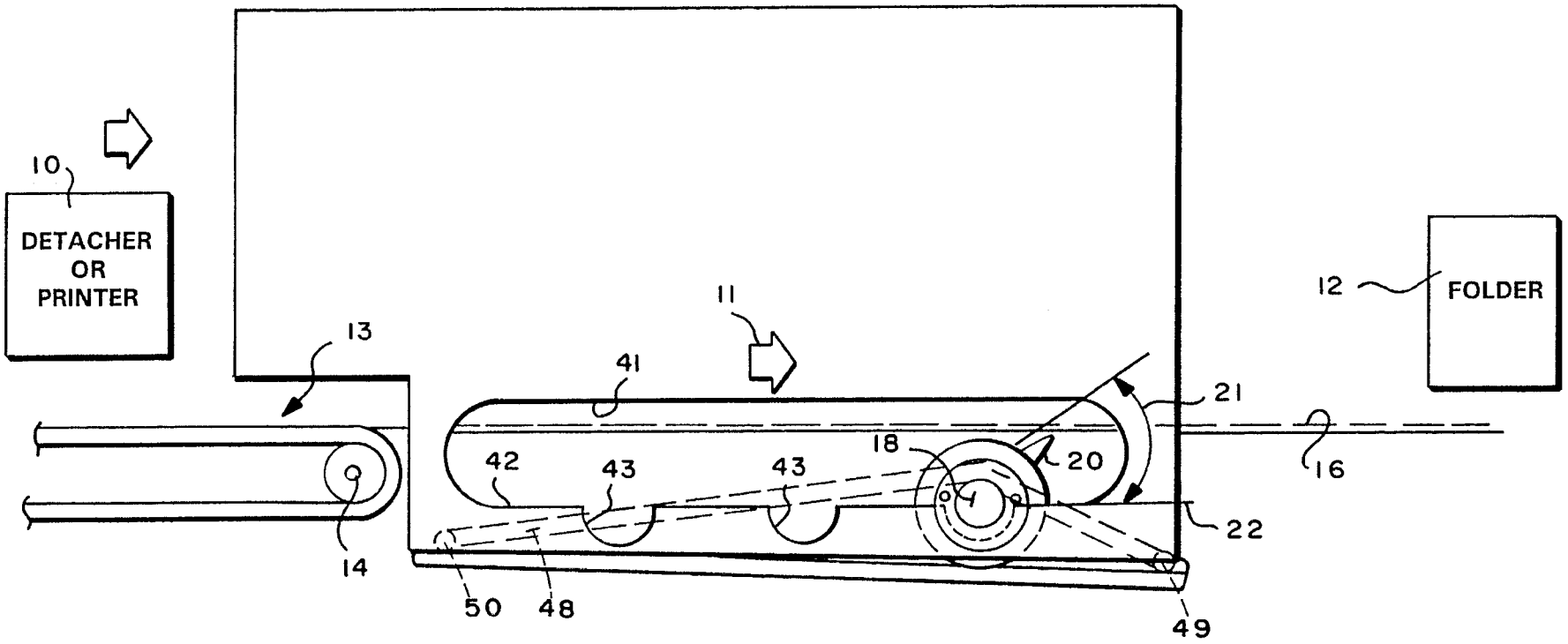
FIG. 1 is a side schematic view of exemplary apparatus according to the present invention.

FIG. 1 illustrates a first piece of forms handling equipment, such as a printer or detacher 10, from which business forms or other sheets are ted in a first direction 11 to a second piece of forms handling equipment such as a folder 12. Means for feeding the forms in the first direction 11 may comprise the conveyor tapes 13 seen in FIGS. 1 and 3, FIG. 3 illustrating the tapes 13 spaced from each other in a generally horizontal direction perpendicular to the first direction 11 and passing around an end roller 14 which terminates sort of the folder 12. During feeding with the conveyor belts or tapes 13, then, there will be a time when the sheets or forms—illustrated in dotted line at 15 in FIG. 3 and in solid line in FIG. 2—are not supported.

Depending upon the speed of feed in the direction 11, the weight, thickness, or number of parts of the sheet or form 15, and the like, the sheet or form 15 may have a tendency to droop when not supported. If the sheet does droop, the leading edge of the form may be scuffed, which could hinder its feeding to the downstream forms handling equipment 12, or make it unsuitable for use, or could clog up the equipment especially considering that the speed of movement of the sheets or forms in the direction 11 is normally high, typically on the order of 375 feet per minute. Drooping occurs when the sheet or form 15 travelling in the direction 11 moves significantly downwardly below the plane 16, which is generally horizontal, and typically an extension of the tapes 13.

According to the present invention very simple means are provided mounted below the plane 16 for engaging, supporting, and typically also creasing (to enhance rigidity), the sheets or forms 15 as they are fed in the direction 11. These engaging, supporting, and creasing means preferably comprise a stationary rod 18 having at least one collar 19 mounted thereto, with a support pin 20 extending radially outwardly from the collar 19 substantially perpendicular to the rod 18. The support pin 20 typically makes an "engagement angle" 21 (see FIG. 1) with respect to a second horizontal plane 22 parallel to the plane 16 and passing through the center of the rod 18. The angle 21 is over 50° and up to 90°, although preferably slightly less than 90° at the most. Typically the angle 21 is 55°–85°, optimally 60°.

An exemplary support pin 20 may be utilized according to the present invention is shown in detail in FIG. 4. The pin 20 includes a shaft section 24 and a substantially truncated cone end 25 with a rounded tip 26. The pin 20 is typically made of a hard durable material such as stainless steel.

Exerting a downward force (pressure) on the sheets 15 to facilitate creasing of the sheet 15 by support pin 20 are the weighted nip wheels 23 on arms 23' (see FIG. 3), having their horizontal axis of rotation defined by shaft 27 mounted for pivotal movement about conventional arms (not shown). The wheels 23 are above the horizontal plane 16.

An exemplary collar 19 according to the invention is shown most clearly in FIGS. 3 and 5 through 7. It includes a first radial bore 28 (see FIGS. 5 and 6) which receives the shaft 24 of the pin 20. The pin 20 may be held tightly in the bore 28 by a set screw 29 or the like which passes through an opening intersecting the bore 28, parallel to the central opening 30 in the collar 19. The collar 19 has—as seen in FIGS. 2, 3, and 5 through 7—a disc-shape, the bore 30 being at the center of the disc, and having a diameter just slightly greater than the outside diameter of the shaft 18.

The collar 19 also comprises a second, screw threaded, radial bore 32 (see FIGS. 5 through 7) which is adapted to receive the screw threaded fastener 33 therein. The bore 32 intersects the bore 30, and the fastener 32 is adapted to be screw threaded into the position where it intersects the bore 30, and thus—if the collar 19 is mounted on the rod 18—frictionally engages the rod 18, preventing movement of the collar 19 either axially (in dimension 35 seen in FIG. 3), or rotatably with respect to the rod 18. The collar 19 is typically also of a hard material, which is capable of being machined, such as chromium steel.

While the preferred embodiment is illustrated in drawings for the pin 20, collar 19, and rod 18, it is to be understood that they could have different configurations. For example the rod 18 could be polygonal in cross-section, and the bore 30 could be of a comparable polygon, the engagement angle 21 then being adjusted by sliding the collar 19 off of the rod 18 and then repositioning it, and the screw 33 being provided merely to hold the collar 19 in the axial (in dimension 35) position to which it has been moved with respect to the rod 18.

Figure 2:
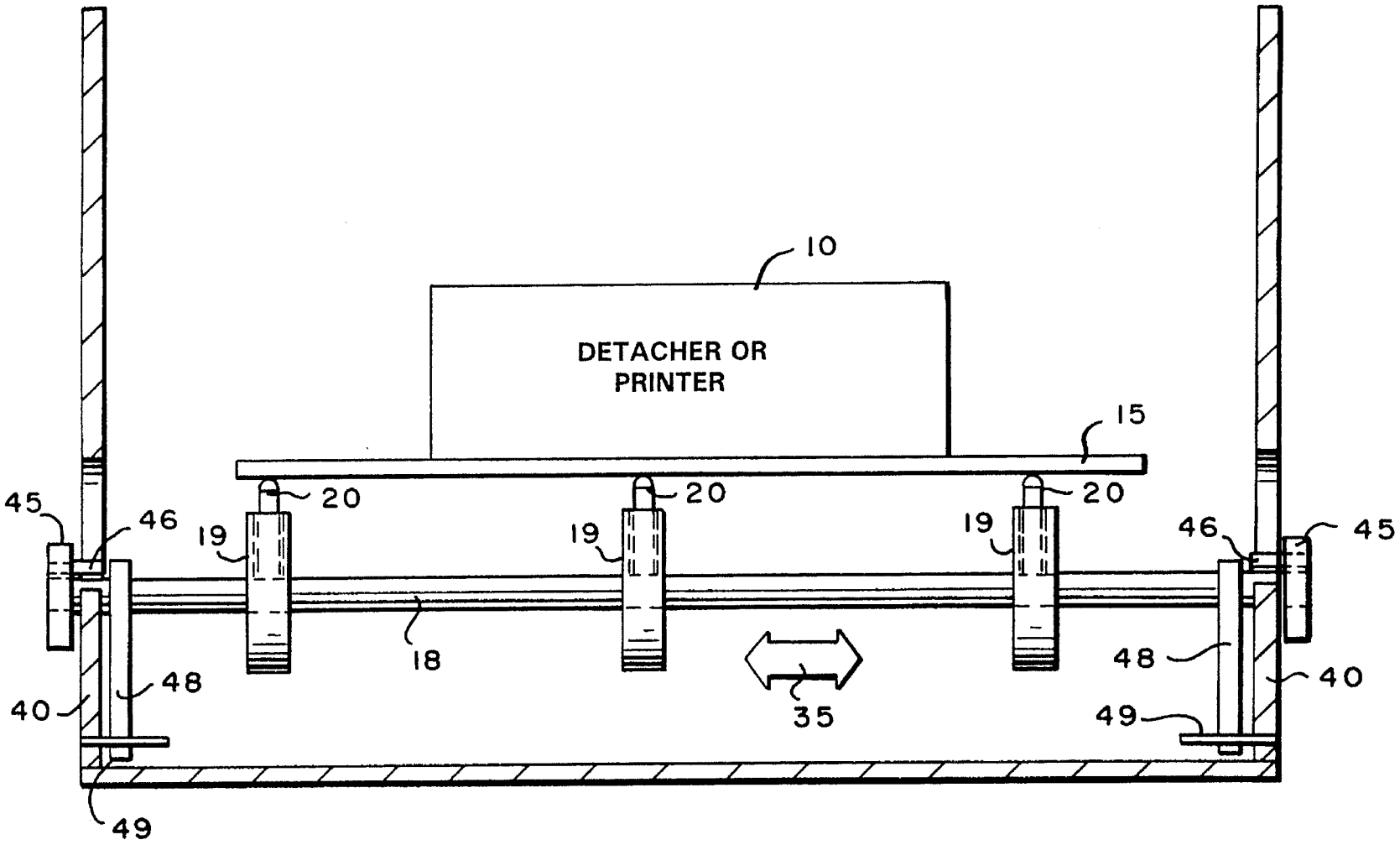
FIG. 2 is a front view, partly in cross-section and partly in elevation, of the apparatus of FIG. 1.

Also, as clearly illustrated in FIGS. 2 and 3, it is preferred that a plurality of support pins 20 and associated collars 19 be provided on the rod 18, such as three evenly spaced—in the axial dimension 35—collar and pin sets 19, 20, for engaging the bottom of the sheet or form 15 at spaced locations.

According to the present invention there also preferably is provided third adjustment means for adjusting the position of the rod 18 with respect to the feeding means 13. In the preferred embodiment illustrated in FIGS. 1 through 3, the third adjustment means comprises first and second notched side plates 40, the notches either being provided in the top thereof, or—as illustrated in the drawings (particularly FIGS. 1 and 2)—the plates 40 having an elongated (in the first direction 11) slot 41 in each, the bottom edge 42 of each slot 41 having notches 43 formed therein.

The rod 18 may be positioned in any one of the notches 43 (three notches being seen in FIG. 1, although any number may be provided), the notches 43 spaced different distances in the direction 11 from the roller 14. In order to prevent rotation of the shaft 18, an engagement means is associated with the side plates 40 for holding the rod 18 in position in a pair of aligned notches 43 in the side plates 40. The engagement means preferably comprises a pair of outer collars 45 at the opposite ends of the rod 18, and preferably on the opposite sides of the side plates 40 from the collars 19. The outer collars 45 have at least one, and preferably two roll pins 46 associated therewith extending in the dimension 35 and engaging the surface 42 of the side plate 40 adjacent a notch 43. The engagement means may also further comprise one or two elastic (e.g. polyurethane) bands 48 which are connected by pins 49, 50 to the side walls 40, and extend over the rod 18, providing a biasing force biasing the rod 18 downwardly into the notch 43. While this biasing force, combined with the roll pins 46, is sufficient to positively preclude any movement of the rods 18 during normal use, the bands 48 allow ready repositioning of the rod 18, the operator merely grabbing the rod 18, lifting up against the bias of the bands 48, moving it to the next notch.

In a typical use of the apparatus of FIGS. 1 through 3, as a sheet or form 15 is being fed in the direction 11 it moves past the end (roller 14) of the conveyor tapes 13, and while airborne engages the pins 20, the pins supporting the bottom of the sheet 15 and typically providing a small crease therein for increased rigidity. This precludes drooping, and scuffing of the leading edge, of the sheet 15 so that sheet 15 positively and correctly feeds to the folder 12. The position of the pins 20 in the dimension 35, and/or the angular position thereof (the angle 21), is easily adjusted to accommodate different sheets, feed speeds, etc., by loosening the screws 33 and then retightening them after the appropriate adjustment has been made. Different form lengths are easily accommodated by moving the rod 18 against the bias of the bands 48 to different notches 43.

It will thus be seen that according to the present invention an advantageous apparatus for preventing sheet drooping during sheet feeding has been provided, the apparatus being the epitome of simplicity, yet being highly versatile for most effective operation. While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent structures and devices.

What is claimed is:

1. Apparatus for preventing sheet drooping during sheet feeding in a first direction in a generally horizontal plane where a sheet is not fully supported by a conveyor, comprising:

means for feeding forms in the first direction in a generally horizontal plane; and means mounted below the plane for engaging, and supporting the bottom of a sheet moving in the first direction when the sheet droops;

said means mounted below the plane comprising: a stationary rod; at least one collar mounted to said rod; and a support pin extending radially outwardly from said collar substantially perpendicular to said rod, said support pin making an engagement angle of between about 55 and 90 degrees with respect to a second plane parallel to the generally horizontal plane and passing through said rod.

2. Apparatus as recited in claim 1 further comprising first adjustment means for mounting said support pin to said collar and said rod to allow adjustment of said engagement angle.

3. Apparatus as recited in claim 2 further comprising second adjustment means for mounting said collar to said rod to allow adjustment of the position of said collar and support pin along said rod.

4. Apparatus as recited in claim 3 wherein said first and second adjustment means comprise a threaded bore in said collar extending radially with respect to said rod, and a threaded clamping screw extending into said bore and frictionally engaging said rod to hold said collar in both a circumferential and axial position on said rod to which it has been adjusted.

5. Apparatus as recited in claim 4 further comprising third adjustment means for adjusting the position of said rod with respect to said feeding means.

6. Apparatus as recited in claim 5 wherein said third adjustment means comprises first and second notched side plates extending parallel to said first direction on opposite sides of said rod, and engagement means for engaging said side plates and holding said rod in position in a pair of aligned notches in said side plates, and wherein said engagement means comprise a pair of outer collars mounted to said rod, opposite a side plate from said support pin; and at least one roll pin mounted on each said outer collars for engaging a side plate and precluding rotation of said rod in said notches.

7. Apparatus as recited in claim 6 wherein said engagement means further comprises at least one elastic band extending over said rod for biasing said rod into said notches, but allowing movement of said rod out of said notches against said biasing.

8. Apparatus as recited in claim 1 further comprising weighted nip wheels disposed above a sheet being ted in the first direction and for applying a force to the sheet to facilitate creasing thereof by said support pin.

9. Apparatus as recited in claim 1 wherein said support pin has a truncated cone end, with a rounded tip at said end, for engaging a sheet, and wherein said engagement angle is between about 60°–85°, and wherein said pin creases the sheet.

10. Apparatus as recited in claim 1 wherein said feeding means comprises a plurality of conveyor tapes spaced from each other in a direction perpendicular to the first direction, said tapes terminating in an end roller spaced from said rod in said first direction.

11. Apparatus as recited in claim 1 further comprising second adjustment means for mounting said collar to said rod to allow adjustment of the position of said collar and support pin along said rod.

12. Apparatus as recited in claim 11 wherein said second adjustment means comprise a threaded bore in said collar extending radially to said rod, and a threaded clamping screw extending into said bore and frictionally engaging said rod to hold said collar in both a circumferential and longitudinal position on said rod to which it has been adjusted.

13. Apparatus as recited in claim 12 wherein said threaded bore is space ninety degrees from said support pin around the circumference of said collar.

14. Apparatus as recited in claim 1 wherein said at least one collar comprises at least two collars mounted to said rod; and a support pin extending radially outwardly from each of said at least one other collar, substantially perpendicular to said rod, said support pins making an engagement angle of between about 55 and 85 degrees with respect to a second plane parallel to said generally horizontal plane and passing through said rod.

15. Apparatus as recited in claim 1 further comprising third adjustment means for adjusting the position of said rod with respect to said feeding means.

16. Apparatus as recited in claim 15 wherein said third adjustment means comprises first and second notched side plates extending parallel to said first direction on opposite sides of said rod, and engagement means for engaging said side plates and holding said rod in position in a pair of aligned notches in said side plates, and wherein said engagement means comprise a pair of outer collars mounted to said rod, opposite a side plate from said support pin; and at least one roll pin mounted on each said outer collars for engaging a side plate and precluding rotation of said rod in said notches.

* * * * *